US008936085B2

(12) United States Patent
Boney et al.

(10) Patent No.: US 8,936,085 B2
(45) Date of Patent: Jan. 20, 2015

(54) SEALING BY BALL SEALERS

(75) Inventors: Curtis L. Boney, Houston, TX (US); Jason Swaren, Sugar Land, TX (US); John Lassek, Katy, TX (US); Ricardo Ariza, Conroe, TX (US); Desmond E. Rees, Tyler, TX (US); David Ryan Simon, Fort Smith, AR (US); Michael A. Dardis, Longview, TX (US); Darrel P. Davis, Longview, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/103,041

(22) Filed: Apr. 15, 2008

(65) Prior Publication Data

US 2009/0255674 A1 Oct. 15, 2009

(51) Int. Cl.
*E21B 33/13* (2006.01)
*E21B 33/138* (2006.01)

(52) U.S. Cl.
CPC ..... *E21B 33/138* (2013.01)
USPC ..... 166/284; 166/270.1; 166/270.2; 166/280.1; 166/300

(58) Field of Classification Search
CPC ..... E21B 33/138
USPC ..... 166/262, 270, 270.1, 280.1, 280.2, 284, 166/285, 300, 305
See application file for complete search history.

(56) References Cited

U.S. PATENT DOCUMENTS 2,754,910 A 7/1956 Derrick et al.
2,933,136 A * 4/1960 Ayers et al. ..... 166/284
3,144,049 A * 8/1964 Ginsburgh ..... 138/97
3,292,700 A * 12/1966 Berry ..... 166/284
3,437,147 A * 4/1969 Davies ..... 166/284
3,480,079 A 11/1969 Wright et al.
RE27,459 E * 8/1972 Guinn et al. ..... 166/250.01
3,974,077 A 8/1976 Free
3,998,272 A 12/1976 Maly
4,102,401 A 7/1978 Erbstoesser et al.
4,194,561 A * 3/1980 Stokley et al. ..... 166/162

(Continued)

FOREIGN PATENT DOCUMENTS

EP 0278540 8/1992
MX PA03008050 A 1/2004

(Continued)

OTHER PUBLICATIONS

SPE 39945—Induced Stress Diversion: A Novel Approach to fracturing Multiple Pay Sands of the NBU Field, Uintah Co. Utah—SK Schubarth, SL Cobb and RG Jeffrey.

(Continued)

*Primary Examiner* — James G Sayre

(57) ABSTRACT

In downhole treatments in the oilfield, ball sealers seated in perforations may not fully seal and may leak fluid through gaps and asperities between the balls and the perforations. A method is given for improving the sealing of ball sealers in perforations by adding a sealing agent that forms a plug in the gaps and severely restricts or eliminates fluid flow. The sealing agent is preferably degradable or soluble, malleable fibers slightly larger than the gaps. Optionally, the particles may be non-degradable, rigid, of different shapes, and smaller than the gaps but able to bridge them. Mixtures of sealing agents may be used. The sealing agent may be added with the ball sealers, after the ball sealers, or both.

13 Claims, 2 Drawing Sheets

(56) References Cited

U.S. PATENT DOCUMENTS

| | | | | |
|---|---|---|---|---|
| 4,244,425 | A | 1/1981 | Erbstoesser | |
| 4,387,769 | A | 6/1983 | Erbstoesser et al. | |
| 4,407,368 | A | 10/1983 | Erbstoesser | |
| 4,505,334 | A | 3/1985 | Doner et al. | |
| 4,702,316 | A | 10/1987 | Chung et al. | |
| 4,715,967 | A | 12/1987 | Bellis et al. | |
| 4,716,964 | A * | 1/1988 | Erbstoesser et al. | 166/284 |
| 4,753,295 | A * | 6/1988 | Gabriel et al. | 166/284 |
| 4,766,182 | A | 8/1988 | Murdoch et al. | |
| 4,986,355 | A | 1/1991 | Casad et al. | |
| 5,253,709 | A * | 10/1993 | Kendrick et al. | 166/284 |
| 5,258,137 | A | 11/1993 | Bonekamp | |
| 5,309,995 | A | 5/1994 | Gonzalez et al. | |
| 5,330,005 | A | 7/1994 | Card | |
| 5,377,760 | A * | 1/1995 | Merrill | 166/295 |
| 5,439,055 | A | 8/1995 | Card | |
| 5,485,882 | A | 1/1996 | Bailey et al. | |
| 5,501,275 | A | 3/1996 | Card | |
| 5,551,516 | A | 9/1996 | Norman | |
| 5,924,295 | A | 7/1999 | Park | |
| 5,964,295 | A | 10/1999 | Brown | |
| 5,979,557 | A | 11/1999 | Card | |
| 5,990,051 | A | 11/1999 | Ischy et al. | |
| 6,172,011 | B1 | 1/2001 | Card | |
| 6,330,916 | B1 * | 12/2001 | Rickards et al. | 166/280.2 |
| 6,380,138 | B1 * | 4/2002 | Ischy et al. | 507/204 |
| 6,435,277 | B1 | 8/2002 | Qu | |
| 6,599,863 | B1 | 7/2003 | Palmer | |
| 6,667,280 | B2 | 12/2003 | Chang | |
| 6,703,352 | B2 | 3/2004 | Dahayanake | |
| 6,742,590 | B1 * | 6/2004 | Nguyen | 166/280.1 |
| 6,776,235 | B1 * | 8/2004 | England | 166/271 |
| 6,837,309 | B2 | 1/2005 | Boney | |
| 6,938,693 | B2 | 9/2005 | Boney | |
| 7,055,604 | B2 | 6/2006 | Jee | |
| 7,066,266 | B2 * | 6/2006 | Wilkinson | 166/308.1 |
| 7,166,560 | B2 | 1/2007 | Still | |
| 7,244,492 | B2 * | 7/2007 | Sinclair et al. | 428/325 |
| 7,273,104 | B2 | 9/2007 | Wilkinson et al. | |
| 7,275,596 | B2 | 10/2007 | Willberg et al. | |
| 7,350,572 | B2 | 4/2008 | Fredd et al. | |
| 2002/0007949 | A1 | 1/2002 | Tolman | |
| 2003/0060374 | A1 | 3/2003 | Cooke, Jr. | |
| 2003/0062160 | A1 | 4/2003 | Boney et al. | |
| 2003/0106690 | A1 | 6/2003 | Boney et al. | |
| 2003/0119680 | A1 | 6/2003 | Chang | |
| 2004/0152601 | A1 | 8/2004 | Still | |
| 2004/0152604 | A1 | 8/2004 | Qu | |
| 2004/0261993 | A1 | 12/2004 | Nguyen | |
| 2005/0000690 | A1 | 1/2005 | Boney | |
| 2005/0113263 | A1 | 5/2005 | Brown | |
| 2005/0126786 | A1 | 6/2005 | Fu | |
| 2005/0230107 | A1 | 10/2005 | McDaniel | |
| 2005/0272613 | A1 * | 12/2005 | Cooke | 507/219 |
| 2006/0000609 | A1 | 1/2006 | Cavazzoli et al. | |
| 2006/0021753 | A1 | 2/2006 | Wilkinson | |
| 2006/0032633 | A1 * | 2/2006 | Nguyen | 166/280.2 |
| 2006/0042797 | A1 | 3/2006 | Fredd | |
| 2006/0118301 | A1 | 6/2006 | East, Jr. et al. | |
| 2006/0169453 | A1 | 8/2006 | Savery | |
| 2006/0175059 | A1 | 8/2006 | Sinclair et al. | |
| 2006/0283591 | A1 | 12/2006 | Willberg | |
| 2007/0044958 | A1 | 3/2007 | Rytlewski et al. | |
| 2007/0187099 | A1 * | 8/2007 | Wang | 166/295 |
| 2008/0196896 | A1 | 8/2008 | Bustos et al. | |
| 2009/0101334 | A1 | 4/2009 | Baser et al. | |

FOREIGN PATENT DOCUMENTS

| | | | |
|---|---|---|---|
| RU | 2166617 | C2 | 5/2001 |
| WO | 0206629 | A1 | 1/2002 |
| WO | 2004018840 | A1 | 3/2004 |
| WO | 2007015060 | A1 | 2/2007 |

OTHER PUBLICATIONS

SPE 37489—Understanding Proppant Closure Stress—T. W. Hewett and C.J. Spence.

* cited by examiner

SEALING BY BALL SEALERS

BACKGROUND OF THE INVENTION

Wellbore isolation during stimulation (for example by fracturing, acidizing, and acid fracturing) is performed by a variety of methods within the oilfield industry. One of the approaches involves the use of ball sealers, which are meant to seal the perforations and prevent fluid in the wellbore from flowing through the perforations into the formation.

Ball sealers are typically spheres designed to seal perforations that are capable of accepting fluid, and thus divert reservoir treatments to other portions of a target zone. Ball sealers are slightly larger than the perforations and are incorporated in the treatment fluid and pumped with it. They are carried to the perforations by the fluid flow, seat in the holes, and are held there by differential pressure. The effectiveness of this type of mechanical diversion requires keeping the balls in place and completely blocking the perforations, and depends on factors such as the differential pressure across the perforation, the geometry of the perforation, and physical characteristics of the ball sealers.

Ball sealers are made in a variety of diameters, densities, and compositions, to adjust for different wellbore conditions and for perforation size. They may be either soluble or non-soluble. Soluble ball sealers are most commonly made of one soluble component, while non-soluble ball sealers often consist of a rigid core surrounded by a rubber (or other material) coating. The shortcoming of either ball sealer type lies in the relationship of the shape and composition of the ball sealer and the shape of the entry hole in the casing. Due to the nature of shooting perforations into casings, one obtains burrs and uneven surfaces that are difficult to seal with a smooth and/or spherical ball. In addition, an elongation of the entry hole may occur due to the casing curvature and the gun orientation when shooting perforations with a non-centralized perforating gun.

There is a need for improving the ability of ball sealers to close off perforations completely. This invention provides such a method involving pumping suitable particles, for example fibers, that plug the small flow paths that may otherwise remain in the perforations around the seated ball sealers.

SUMMARY OF THE INVENTION

One embodiment of the Invention is a method for improving the seal of ball sealers seated in holes in a casing in a well penetrating a subterranean formation when there is at least one gap between a ball sealer and a hole (for example a perforation) in which it is seated. The method involves injecting a sealing agent that includes particles that form a plug that inhibits fluid flow through the gap. The sealing agent may optionally be a fiber, may optionally be malleable, may optionally be degradable under downhole conditions, and may optionally be soluble in the formation fluid or in a well treatment fluid that is already present or subsequently injected. The sealing agent may be a mixture of fibers and particles of a shape other than fibrous, and the fibers and particles of a shape other than fibrous may differ in composition. Some or all of the particles may have at least one dimension smaller than the gap, or at least one dimension larger than the gap. The sealing agent may be a mixture of sizes in which some of the particles have at least one dimension smaller than the gap and some of the particles have at least one dimension larger than the gap.

The sealing agent may be injected with the ball sealers; optionally only a portion of the sealing agent may be injected with the ball sealers and the remainder after the ball sealers. All of the sealing agent may be injected after the ball sealers. The sealing agent may be injected remedially, that is after at least one well treatment fluid has been injected, and leaking around previously placed ball sealers is detected or suspected. After a diverting step, the sealing agent may be included in a subsequently diverted treatment fluid, preferably at low concentration. The sealing agent may be released from a downhole tool, for example a basket or bailer.

Another embodiment of the Invention is a method for improving the seal of a ball seated in an orifice in a tool in a well penetrating a subterranean formation when there is at least one gap between the outer boundary of the ball and the inner boundary of the orifice in which it is seated. The method involves injecting a sealing agent including particles that form a plug that inhibits fluid flow through the gap.

Yet another embodiment of the Invention is a composition for diverting fluid from holes, for example perforations, that includes particles that form a plug that inhibits fluid flow through a gap between a seated ball sealer and a perforation.

DETAILED DESCRIPTION OF THE INVENTION

Figure 1:
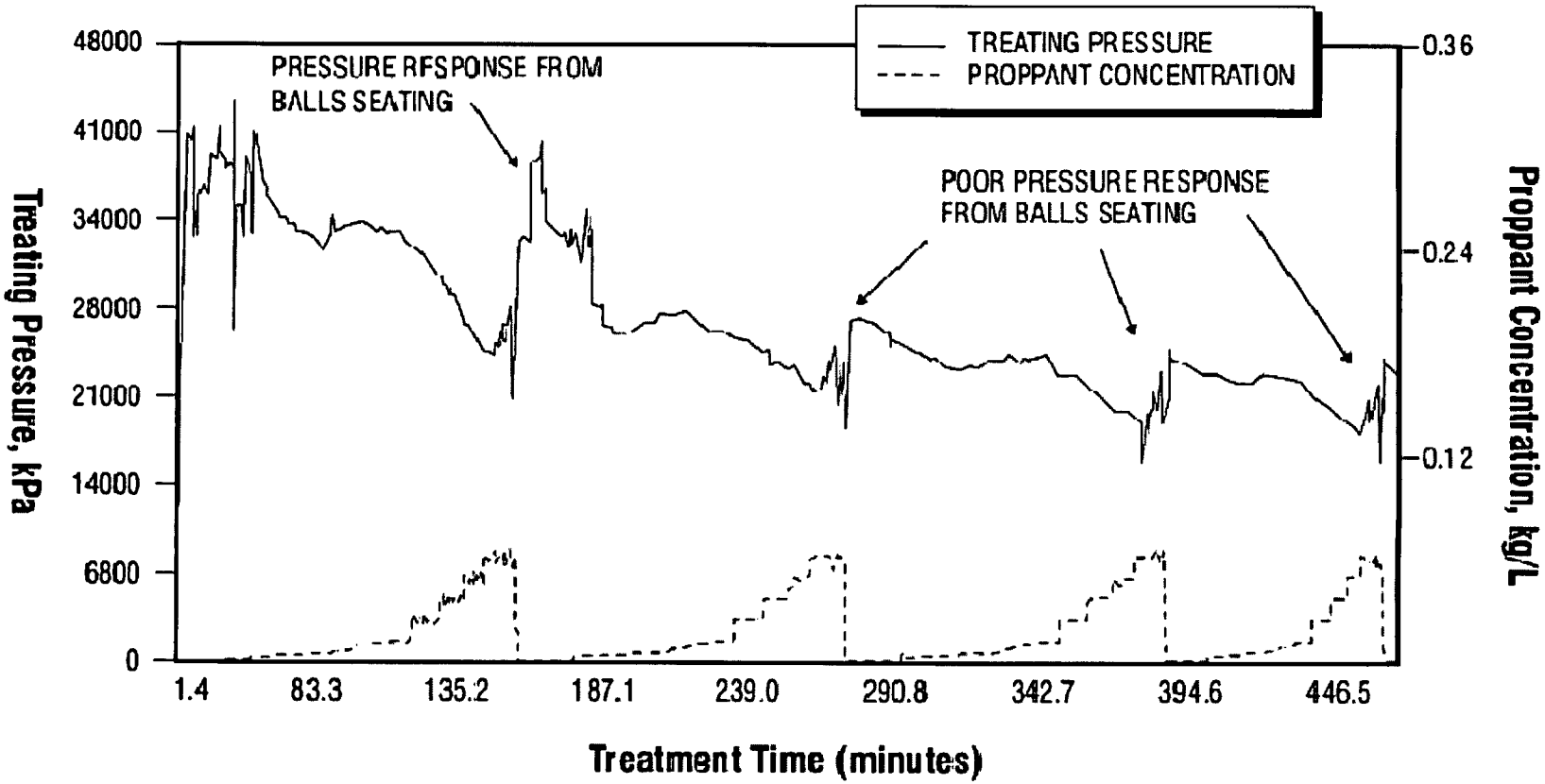
FIG. 1 shows the surface pressure vs. time in a typical multiple fracture treatment with ball sealers used for diversion between stages.

The description and examples are presented solely for the purpose of illustrating the different embodiments of the invention and should not be construed as a limitation to the scope and applicability of the invention. While the compositions of the present invention are described herein as comprising certain materials, it should be understood that the composition could optionally comprise two or more chemically different materials. In addition, the composition can also comprise some components other than the ones already cited. Although some of the following discussion emphasizes fracturing, the compositions and methods of the Invention may be used in any well treatment in which diversion is needed. Examples include fracturing, acidizing, water control, chemical treatments, and wellbore fluid isolation and containment. The invention will be described in terms of treatment of vertical wells, but is equally applicable to wells of any orientation. The invention will be described for hydrocarbon production wells, but it is to be understood that the invention may be used for wells for production of other fluids, such as water or carbon dioxide, or, for example, for injection or storage wells. It should also be understood that throughout this specification, when a concentration or amount range is described as being useful, or suitable, or the like, it is intended that any and every concentration or amount within the range, including the end points, is to be considered as having been stated. Furthermore, each numerical value should be read once as modified by the term "about" (unless already expressly so modified) and then read again as not to be so modified unless otherwise stated in context. For example, "a range of from 1 to 10" is to be read as indicating each and every possible number along the continuum between about 1 and about 10. In other words, when a certain range is expressed, even if only a few specific data points are explicitly identified or referred to within the range, or even when no data points are referred to within the range, it is to be understood that the inventors appreciate and understand that any and all data points within the range are to be considered to have been specified, and that the inventors have possession of the entire range and all points within the range.

When multiple hydrocarbon-bearing zones are stimulated by hydraulic fracturing or chemical stimulation, it is desirable to treat the multiple zones in multiple stages. In multiple-zone fracturing, for example, a first pay zone is fractured. Then, the fracturing fluid is diverted to the next stage to fracture the next pay zone. The process is repeated until all pay zones are fractured. Alternatively, several pay zones may be fractured at one time, if they are closely located and have similar properties. Diversion may be achieved with various means. Some commonly used methods for diversion in multiple fracturing stages are bridge plugs, packers, other mechanical devices, sand plugs, limited entry, chemical diverters, self-diverting fluids, and ball sealers.

It should be noted that while the present discussion is in terms of perforations and perforating guns, other openings in the casing, and other methods of making them, fall within the scope of the Invention. For example, "perforations" may be holes cut in the casing by a jetting tool or by a chemical flash technique, for example using an explosive or a propellant. Such holes are commonly not circular. Furthermore, perforating guns are commonly not centralized in a wellbore (for example, so that other tools may pass by them); when non-centralized guns shoot shots not aimed perpendicular to the casing, non-circular perforations result. Even initially circular holes (as well as non-circular holes) may initially have or may develop asperities. Initial asperities may come, for example, from the burrs (or metal ridges and/or other uneven and irregular surfaces) that are commonly left in, on, and along the edges of the holes inside a casing after perforation. Asperities may develop after the holes are formed, for example by erosion caused by pumping proppant slurry or by corrosion caused by pumping acid.

Ball sealers used in the Invention may be any known ball sealers, of any suitable composition and three dimensional shape. Nonlimiting examples include sphere, egg shaped, pear shaped, capsular, ellipsoid, granular, and the like, and the surfaces of such may very from essentially smooth to rough. Ball sealers, and components forming them, may have any size and shape suitable for the application; sizes and shapes are selected on the basis of the size and shape of the holes to be sealed. Any suitable materials may be used to form the ball sealers. Nonlimiting examples of materials useful for making ball sealers include phenolic resin, nylon resin, syntactic foam, curable materials with high compressive strength, polyvinyl alcohol, collagen, rubber, polyglycolic acid, and polylactic acid. Ball sealers may have a core of one material, typically rigid, and an outer layer of another, typically deformable, for example rubber over metal. Some of these materials have the ability to undergo elastic and/or plastic deformation under pressure, but this may not be sufficient to create satisfactory seals. Some of these materials may be degradable or soluble.

We have now found that the sealing ability of ball sealers may be improved by adding a "sealing agent" to the fluid that carries the balls to the perforations. The improvement may be a complete or a partial stoppage of leaks; the improvement may be permanent or temporary. The sealing agent is a solid particulate material that is carried to and forms a plug in any gaps or asperities between the ball and the perforation where the ball has seated and is attempting to seal. Formation of the plug is caused by the flow resulting from a leak. For typical ball sealer and perforation sizes, the gaps or asperities may typically range in size from about 0.03 to about 0.75 cm. Many materials and shapes are suitable for the sealing agent, but the preferred materials are degradable, or dissolvable, and the preferred shapes are fibers. If the sealing agent is degradable or dissolvable, it naturally disappears in time under the downhole conditions. A suitable material is chosen so that it degrades or dissolves in an appropriate time (by the time flow through the perforation is again desired) under the downhole conditions (for example of temperature, salinity, and pH). If the sealing agent is non-degradable, it is removed in the same way and at the same time as non-degradable balls are removed, by reversing the fluid flow with a sufficient pressure differential. The insoluble or non-degradable sealing agent (and/or the balls) are then allowed to fall to the bottom of the wellbore, or to float or be carried to the surface, as desired. Degradable sealing agents are preferred so that they don't interfere with other operations or equipment after the diversion treatment has been completed. Malleable sealing agents are preferred because they may deform, which may aid in forming a leak-free plug. However, non malleable sealing agents may be used, especially if the ball sealers are deformable. Further, if the outer shell of the ball sealers is suitable, sufficiently rigid sealing agent particles may partially penetrate the ball, which may improve the seal. An example would be a metal sealing agent (for example a fiber) and a rubber-coated ball. Some or all of the individual particles of the sealing agent may have at least one dimension larger than the gaps or asperities between the ball and the hole. Optionally, some or all of the sealing agent particles may be smaller than the gaps or asperities between the ball and the hole but large enough for a small number of particles to bridge across the gaps; determining the sizes of particles that bridge gaps is well known in the art. Optionally, the sealing agent may be a mixture of particles larger than the gaps or asperities and smaller than the gaps or asperities, or even smaller than (but capable of bridging in) gaps formed initially in the plug formed by the larger sealing agent particles. If present as the balls reach the holes, sealing agent particles should be small enough, and optionally but preferably malleable enough, not to interfere with the seating of the balls.

The sealing agents may be in any shape: for example, powders, particulates (for example round, ovoid, cubed, and pellet-shaped), beads, chips, flakes, platelets, ribbons or fibers; they may be random or non-randomly shaped. The particulates may be coated and non-coated, porous and non-porous. Coatings may be used to delay or accelerate degradation or dissolution. Preferred embodiments may use these materials in the form of fibers. The fibers may have a length of about 2 to about 25 mm, preferably about 3 to about 18 mm. Typically, the fibers have a denier of about 0.1 to about 20, preferably about 0.15 to about 6. The fibers may be core-sheath, side-by-side, crimped, uncrimped, bundled, and fibrillated. Known methods for including fibers in treatment fluids and suitable fibers are disclosed in U.S. Pat. No. 5,501,275, which is hereby incorporated by reference in its entirety. Mixtures of fibers and other shapes, for example powders, particulates, beads, chips, flakes, platelets, and ribbons may be used. The fibers alone, or the fibers and other shapes, may all be of the same composition or may be mixtures of materials having different compositions. They may also be made of one material containing a second, filler, material. The different shapes and/or different compositions may also be in different sizes. For example, smaller particles of a different shape may be used to improve the performance of fiber sealing agents even further.

Examples of materials useful as sealing agents in the Invention include water-soluble materials selected from water-soluble inorganic materials (for example carbonates), water-soluble organic materials, and combinations of these materials. Suitable water-soluble organic materials may be water-soluble natural or synthetic polymers or gels. The term polymers includes oligomers, co-polymers, and the like, which may or may not be cross-linked. The water-soluble polymers may be derived from a water-insoluble polymer made soluble by main chain hydrolysis, by side chain hydrolysis, or by a combination of these two methods, for example when exposed to a weakly acidic environment. Furthermore, the term "water-soluble" may have a pH characteristic, depending upon the particular material used. For example, glass fibers are considered water-soluble because they are readily soluble in aqueous HF solutions, and slowly soluble in brines and mildly acidic solutions, especially at higher temperatures. Metals may be solubilized with appropriate salts or acids. Suitable insoluble and/or non-degradable materials include ceramics, some salts, metals (for example steel, aluminum and copper, for example in the form of wires, needles, and shavings) and carbon, for example carbon fibers.

Suitable water-insoluble polymers which may be made water-soluble by acid hydrolysis of side chains include those selected from polyacrylates, polyacetates, and the like and combinations of these materials. Suitable water-soluble polymers or gels include those selected from polyvinyls, polyacrylics, polyhydroxy acids, and the like, and combinations of those materials. Suitable polyvinyls include polyvinyl alcohol, polyvinyl butyral, polyvinyl formal, and the like, and combinations of these materials. Polyvinyl alcohol is available from Celanese Chemicals, Dallas, Tex. U.S.A., under the trade name CELVOL™. Individual CELVOL™ polyvinyl alcohol grades vary in molecular weight and degree of hydrolysis. Polyvinyl butyral is available from Solutia Inc. St. Louis, Mo., U.S.A., under the trade designation BUTVAR™. Suitable polyacrylics include polyacrylamides and the like and combinations of these materials, such as N,N-disubstituted polyacrylamides, and N,N-disubstituted polymethacrylamides. Suitable polyhydroxyacids may be selected from polyacrylic acid, polyalkylacrylic acids, interpolymers of acrylamide/acrylic acid/methacrylic acid, combinations of these materials, and the like.

Suitable materials include polymers or co-polymers of esters, amides, or other similar materials. They may be partially hydrolyzed at non-backbone locations. Examples include polyhdroxyalkanoates, polyamides, polycaprolactones, polyhydroxybutyrates, polyethyleneterephthalates, polyvinyl alcohols, polyvinyl acetate, partially hydrolyzed polyvinyl acetate, and copolymers of these materials. Polymers or co-polymers of esters, for example, include substituted and unsubstituted lactide, glycolide, polylactic acid, and polyglycolic acid. Polymers or co-polymers of amides, for example, may include polyacrylamides. Materials that dissolve at the appropriate time under the encountered conditions are also used, for example polyols containing three or more hydroxyl groups. Polyols useful in the present invention are polymeric polyols solubilizable upon heating, desalination or a combination of these methods, and consist essentially of hydroxyl-substituted carbon atoms in a polymer chain spaced from adjacent hydroxyl-substituted carbon atoms by at least one carbon atom in the polymer chain. In other words, the useful polyols are preferably essentially free of adjacent hydroxyl substituents. In one embodiment, the polyols have a weight average molecular weight greater than 5,000 up to 500,000 or more, and from 10,000 to 200,000 in another embodiment. The polyols may if desired be hydrophobically modified to inhibit or delay solubilization further, e. g. by including hydrocarbyl substituents such as alkyl, aryl, alkaryl or aralkyl moieties and/or side chains having from 2 to 30 carbon atoms. The polyols may also be modified to include carboxylic acid, thiol, paraffin, silane, sulfuric acid, acetoacetylate, polyethylene oxide, quaternary amine, or cationic monomers. In one embodiment, the polyol is a substituted or unsubstituted polyvinyl alcohol that can be prepared by at least partial hydrolysis of a precursor polyvinyl material with ester substituents. Although it is normally not necessary, the degradation may be assisted or accelerated by a wash that contains an appropriate dissolver or that changes the pH or salinity. The degradation may also be assisted by an increase in temperature, for example when the treatment lowers the bottomhole temperature, and that temperature increases with time towards the formation temperature. For example, a fluid having a specific, controlled pH and/or temperature may be pumped into the well; the sealing agent is exposed to the fluid and begins to degrade, depending on the sealing agent composition and the fluid chosen. The degradation may be controlled in time to degrade quickly, for example over a few seconds or minutes, or over longer periods of time, such as hours or days. Below, when we use the terms degradable or soluble, we include all of these suitably dissolvable materials.

Other materials that are suitable as sealing agents of the Invention include materials previously used for fluid loss control, lost circulation control, and diversion. Examples include rock salt, graded rock salt, benzoic acid flakes, wax beads, wax buttons, and oil-soluble resin materials. However, these materials have been used to build filter cakes on wellbore or fracture faces; they have not been used to improve the sealing of ball sealers. The sizes and shapes may be the same as previously used or may be new.

Sealing agents, for example fibers, are typically added in an amount of from about 0.03 lbs (0.013 kg)/perforation to about 0.5 lbs (0.227 kg)/perforation, preferably from about 0.1 to about 0.167 lbs (about 0.045 to 0.076 kg)/perforation. Sealing agents are typically injected at a concentration of from about 2 to about 200 ppt (pounds per thousand gallons) (about 0.24 to about 24 g/l), preferably from about 5 to about 150 ppt (about 0.6 to about 18 g/l). The maximum concentrations of these materials that can be used may be preferred, but may be limited by the surface addition and blending equipment available. Sealing agents are typically added in small slugs of fluid, for example of about 24 bbl (about 3785 liters), although smaller increments, for example 1 bbl (about 160 liters) or less are common. The sealing agent is most commonly added by means of the proppant blender; if the diversion stage follows a proppant stage, some of the sealing agent may be mixed with the last 100 or 200 pounds (22 to 45 kg) of proppant. The sealing agent may be added either at the same time as the ball sealers, or, preferably, in the same fluid but just after the ball sealers. The sealing agent may also be tailed in part way through the release of the ball sealers. The balls and sealing agent may be delivered from a small tubing line provided for that purpose and having a ball dropper, separate from the main injection line or lines. The sealing agent may be injected until a pressure spike indicates that sealing is satisfactory. Any carrier fluid may be used, provided that it can carry the ball sealers and sealing agent, and does not unduly degrade or dissolve either until they are no longer needed. The fluid may, for example, be nitrogen, water, brine, slickwater, a foam, an acid, a gelled oil, or water viscosified, for example, with a linear polymer, a crosslinked polymer, or a viscoelastic surfactant. The perforating tool may be in place, but preferably has been moved away before the balls and sealing agent are placed. The sealing agent and/or the balls may also be released from a downhole tool. For example, the sealing agent may be released from a downhole basket or bailer, for example one having a positive displacement mechanism. Such a bailer may be connected to a wireline, coiled tubing, a jetting device, or a gun assembly. Suitable bailers have been described in U.S. patent application Ser. No. 11/857,859, hereby incorporated in its entirety. The composition and method of the Invention may be used in any type of well and situation in which ball sealers are used: vertical, deviated, horizontal, and multiple; production, storage, injection, and others; stimulation, completion, workover, remediation, and others; wells for hydrocarbons, carbon dioxide, water, brine, helium and other fluids. The typical operation is to shoot a set of perforations, treat a formation, seal the perforations, move the guns and shoot another set, treat, seal, move, shoot, treat, seal, etc. until all zones have been treated. Then the balls and sealing agent are removed. However, it is within the scope of the Invention to shoot more than one set of perforations at once or to remove some of the balls (and associated sealing agent) before all the treatments have been done.

When there is a leak around a ball (a gap between the ball and the hole, for example caused by an asperity in the hole), it may grow worse with time. A leak means fluid flow; fluid flow leads to the possibility of erosion or corrosion, especially if the pressure drop across the partially sealed hole is large, or increases after successive treatments. Although the methods of the Invention are most commonly employed during or immediately after the placement of the ball sealers, it is within the scope of the Invention to use the methods remedially, that is, at some time after the balls are seated, when a leak may develop or be detected. It is also within the scope of the invention to inject a second slurry of sealing agent after an initial treatment with a sealing agent, or to maintain a very low concentration of sealing agent (for example about 0.1 g/l) in a fluid in contact with the balls, for example a fluid being diverted.

Although the Invention has been described in terms of ball sealers used to seal holes in casing, balls (and other devices such as darts) are used in other ways in the oilfield, for example to activate or deactivate tools, to change a flow path within a tool, etc. Seals around these balls or other devices may also leak, and may also be improved by the method of the Invention.

While the invention has been disclosed with respect to a limited number of embodiments, those skilled in the art, having the benefit of this disclosure, will appreciate numerous modifications and variations. It is intended that the appended claims cover such modifications and variations as fall within the true spirit and scope of the invention.

The present invention can be further understood from the following example.

FIG. 1 shows the progress of a fracturing treatment of several successive zones with diversion by ball sealers (without fibers) between stages. The first fracturing treatment started a few minutes into the portion of the job shown; the surface pressure started at about 41,000 kPa and decreased as the fracture was generated and the proppant was pumped. After about two hours, proppant was stopped and balls were dropped. The seal appeared to be good; when the next fracturing treatment was begun, the initial pressure, and the pressure during the proppant stages were about the same as in the first treatment. The process was repeated a third time. However, in this case, when fracturing was resumed (at the same pump rate and proppant concentrations), the surface pressures were much lower, indicating that ball sealers from one or both of the previous treatments were leaking. A fourth fracturing treatment was even worse.

Figure 2:
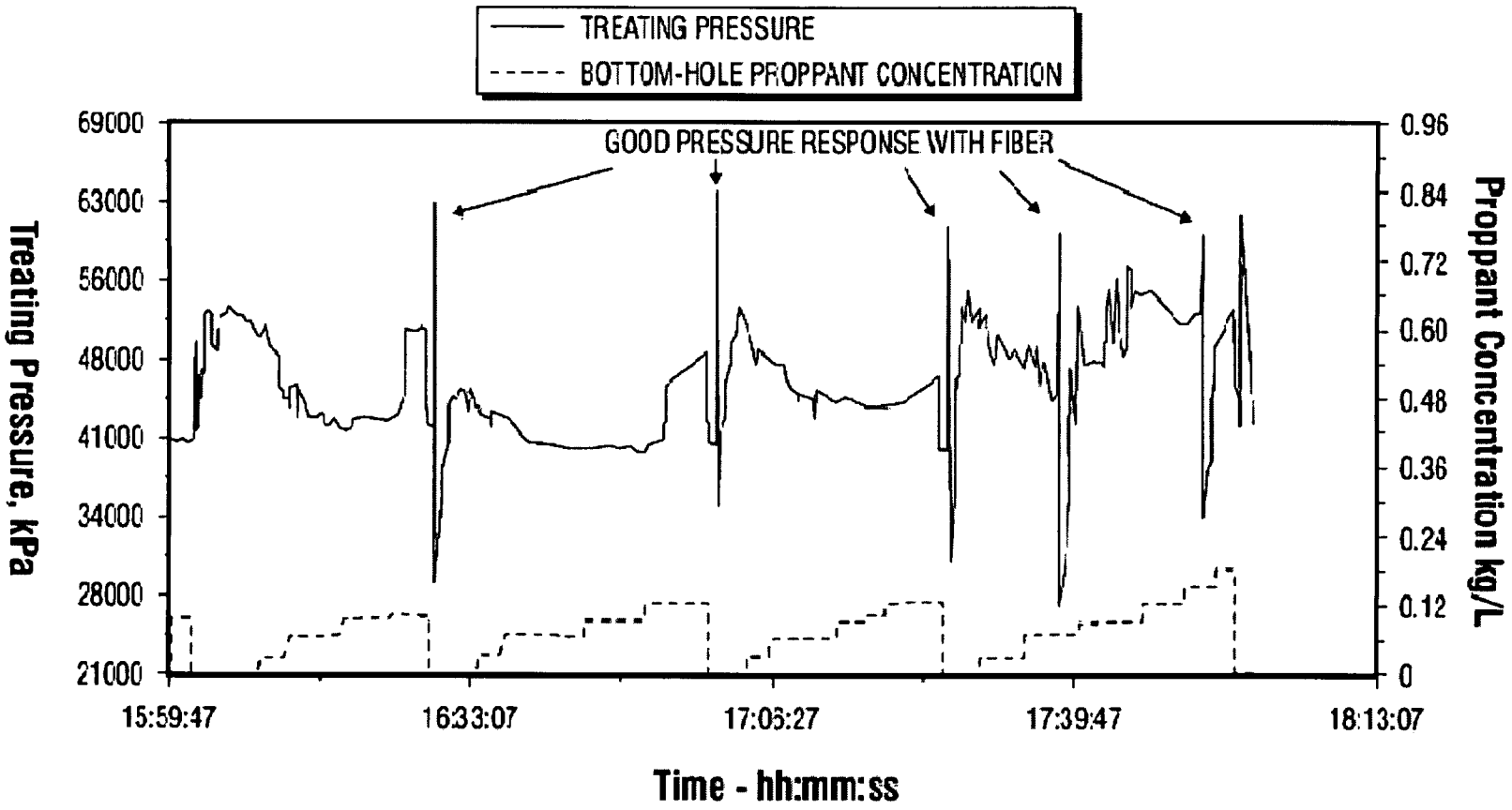
FIG. 2 shows the surface pressure vs. time in a typical multiple fracture treatment with ball sealers and fibers used for diversion between stages.

FIG. 2 shows a comparable job in which polylactic acid fibers were added as sealing agent using the blender. The total amount of fibers added was 40 lbs (18.1 kg) with the concentration varying from 2 to 150 ppt (0.24 to 18 g/l). In this job, it can be seen that the pressure recovered after each diversion step. In fact the pressure went up after each but the first fracturing treatment, which would be expected when fracturing successively lower permeability zones. These results show that the combination of ball sealers plus fibers placed after each treatment was very effective in diverting fracturing fluid to the next set of perforations.

Having thus described our invention, we claim:

1. A method for sealing holes in a casing in a cased well penetrating a subterranean formation, comprising:

injecting ball sealers and a separate sealing agent comprising particles into the casing of the cased well so as to form a plug including a combination of a ball sealer and particles that inhibit fluid flow through a hole in the casing in which the ball sealer is seated, wherein the particles comprise fibers having a length from 5 to 25 mm;

wherein the sealing agent is injected at a rate between 0.013kg/perforation and 0.076 kg/perforation and wherein at least a portion of the sealing agent is injected with the ball sealers; and, wherein some or all of the particles have at least one dimension smaller than a gap between an outer boundary of the ball sealer and the casing, or, some or all of the particles have at least one dimension larger than a gap between an outer boundary of the ball sealer and the casing.

2. The method of claim 1 wherein the sealing agent is malleable.

3. The method of claim 1 wherein the sealing agent is degradable under downhole conditions.

4. The method of claim 1 wherein the sealing agent is soluble in a well treatment fluid.

5. The method of claim 1 wherein the sealing agent further comprises particles of a shape other than fibrous.

6. The method of claim 5 wherein the fibers and particles of a shape other than fibrous differ in composition.

7. The method of claim 1 wherein some of the particles have at least one dimension smaller than a gap between an outer boundary of the ball sealer and the casing, and some of the particles have at least one dimension larger than the gap.

8. The method of claim 1 wherein the sealing at least a portion of the sealing agent is injected after the ball sealers.

9. The method of claim 8 further wherein the ball sealers are injected, at least one well treatment fluid is then injected, and then the sealing agent is injected.

10. The method of claim 1 further wherein sealing agent is included in a subsequently diverted treatment fluid.

11. The method of claim 1 wherein the sealing agent is released from a downhole tool.

12. A method for improving the seal of a ball seated in an orifice in a tool in a well penetrating a subterranean formation, wherein there is at least one gap between the outer boundary of the ball and the inner boundary of the orifice in which it is seated, comprising injecting a sealing agent comprising particles that form a plug that inhibits fluid flow through the gap, wherein the particles comprise fibers having a length from 5 to 25 mm; wherein the sealing agent is injected at a rate between 0.013kg/perforation and 0.076kg/perforation and wherein at least a portion of the sealing agent is injected with the ball sealers.

13. A composition for diverting fluid from perforations comprising a carrier fluid, a plurality of ball sealers, and a sealing agent comprising particles that are separate from the ball sealers, and form a plug that inhibits fluid flow through a gap between a seated ball sealer and a perforation, wherein the particles comprise fibers having a length from 5 to 25 mm; wherein the sealing agent is present in an amount between 2 to 150 pounds per thousand gallons of carrier fluid.

* * * * *

UNITED STATES PATENT AND TRADEMARK OFFICE

CERTIFICATE OF CORRECTION

PATENT NO. : 8,936,085 B2
APPLICATION NO. : 12/103041
DATED : January 20, 2015
INVENTOR(S) : Boney et al.

It is certified that error appears in the above-identified patent and that said Letters Patent is hereby corrected as shown below:

Title Page, Item (75) Inventors should read

-- (75) Inventors: Curtis L. Boney, Houston, TX (US); Jason Swaren, Sugar Land, TX (US); John Lassek, Katy, TX (US); Ricardo Ariza, Conroe, TX (US); Desmond E. Rees, Tyler, TX (US); David Ryan Simon, Fort Smith, AR (US); Michael A. Dardis, Longview, TX (US); Darrell P. Davis, Longview, TX (US) --.

Signed and Sealed this
Third Day of November, 2015

Michelle K. Lee

Michelle K. Lee
*Director of the United States Patent and Trademark Office*